US009462873B2

(12) United States Patent
Casasanta, III

(10) Patent No.: US 9,462,873 B2
(45) Date of Patent: Oct. 11, 2016

(54) COSMETIC FORMULATION DISPENSING HEAD FOR A PERSONAL CARE APPLIANCE

(71) Applicant: L'Oreal, Paris (FR)

(72) Inventor: Vincenzo Casasanta, III, Woodinville, WA (US)

(73) Assignee: L'Oreal, Paris (FR)

( * ) Notice: Subject to any disclaimer, the term of this patent is extended or adjusted under 35 U.S.C. 154(b) by 192 days.

(21) Appl. No.: 14/331,840

(22) Filed: Jul. 15, 2014

(65) Prior Publication Data

US 2016/0015150 A1 Jan. 21, 2016

(51) Int. Cl.

| | |
|---|---|
| ***H02K 33/00*** | (2006.01) |
| ***A45D 40/26*** | (2006.01) |
| ***B65D 47/24*** | (2006.01) |
| ***A61H 23/04*** | (2006.01) |

(Continued)

(52) U.S. Cl.

CPC ..... *A45D 40/262* (2013.01); *A45D 19/02* (2013.01); *A46B 5/0095* (2013.01); *A46B 11/0006* (2013.01); *A46B 11/0027* (2013.01); *A46B 13/023* (2013.01); *A46B 13/04* (2013.01); *A46B 2200/1046* (2013.01)

(58) Field of Classification Search

CPC ... A45D 40/262; A45D 19/02; A46B 5/0095

USPC ..... 401/4, 183–184, 269, 270

See application file for complete search history.

(56) References Cited

U.S. PATENT DOCUMENTS 2,272,641 A * 2/1942 Mureau ..... A45D 40/262 222/390

2,799,881 A * 7/1957 Howe ..... G01F 11/021 222/390

(Continued)

FOREIGN PATENT DOCUMENTS

CN 201452024 U 5/2010

EP 1 459 782 A2 9/2004

(Continued)

OTHER PUBLICATIONS

International Search Report and Written Opinion mailed Oct. 7, 2015, issued in corresponding International Application No. PCT/US2015/028562, filed Apr. 30, 2015, 17 pages.

(Continued)

*Primary Examiner* — Mark A Laurenzi

*Assistant Examiner* — Thomas M Abebe

(74) *Attorney, Agent, or Firm* — Christensen O'Connor Johnson Kindness PLLC

(57) ABSTRACT

A cosmetic formulation applicator is provided for applying cosmetic formulation to a user's skin. The cosmetic formulation applicator includes a reservoir that contains a cosmetic formulation, a brush head base, a plurality of bristles, and one or more dispenser nozzles. The brush head base is attached to the reservoir on a first side of the brush head base and the plurality of bristles extend from a second side of the brush head base. The one or more dispenser nozzles are configured to permit passage of the cosmetic formulation from the reservoir through the brush head base to the plurality of bristles. The cosmetic formulation applicator includes a plunger that is configured to force cosmetic formulation from the reservoir to the plurality of bristles via the plurality of dispenser nozzles. The plunger can be driven to control flow of the cosmetic formulation through the plurality of dispenser nozzles.

20 Claims, 10 Drawing Sheets

(51) Int. Cl.

| | |
|---|---|
| ***A47L 13/22*** | (2006.01) |
| ***A46B 11/00*** | (2006.01) |
| ***A61B 17/00*** | (2006.01) |
| ***A45D 19/02*** | (2006.01) |
| ***A46B 5/00*** | (2006.01) |
| ***A46B 13/02*** | (2006.01) |
| ***A46B 13/04*** | (2006.01) |

(56) References Cited

U.S. PATENT DOCUMENTS 4,533,273 A * 8/1985 Obata ..... A46B 3/005 401/190
4,617,875 A * 10/1986 Holland ..... A01K 13/003 119/603
4,704,226 A * 11/1987 Naylor ..... A61K 8/44 424/70.24
4,974,984 A * 12/1990 Kafkis ..... A45D 34/042 401/186
4,993,859 A * 2/1991 Assad ..... B65D 47/44 401/206
6,022,163 A * 2/2000 Asfur ..... A45D 24/22 132/112
7,157,816 B2 * 1/2007 Pilcher ..... H02K 33/16 310/36
7,481,592 B2 1/2009 Gueret
7,722,277 B2 * 5/2010 Byun ..... A45D 34/04 401/202
7,786,626 B2 * 8/2010 Reishus ..... H02K 33/16 15/22.1
7,794,168 B2 * 9/2010 Chang ..... A46B 11/0013 401/205
8,007,192 B2 8/2011 Huang
8,464,732 B2 6/2013 Wong
8,506,193 B1 * 8/2013 Zhang ..... A45D 40/20 222/110
9,211,756 B2 * 12/2015 Ballot ..... A46B 11/001
2003/0059247 A1 * 3/2003 Kandasamy ..... B65D 47/42 401/184
2006/0210352 A1 * 9/2006 Clark ..... A46B 11/0024 401/277
2008/0083845 A1 * 4/2008 Lind ..... B05B 9/0838 239/696
2008/0106156 A1 * 5/2008 Reishus ..... H02K 33/16 310/36
2008/0167590 A1 * 7/2008 Jon ..... A45D 34/042 601/160
2008/0319446 A1 * 12/2008 Young ..... A61B 17/8822 606/93
2009/0016805 A1 * 1/2009 Byun ..... A45D 34/042 401/277
2009/0020551 A1 * 1/2009 Malvar ..... A45D 40/265 401/132
2009/0097899 A1 * 4/2009 Carroll ..... A45D 40/02 401/109
2009/0154985 A1 6/2009 Wyatt
2009/0180825 A1 * 7/2009 Chang ..... A46B 11/0013 401/129
2010/0132730 A1 * 6/2010 Jung ..... A45D 19/02 132/116
2011/0116857 A1 * 5/2011 Carroll ..... A45D 34/04 401/101
2011/0240766 A1 * 10/2011 Peterson ..... B05B 9/0861 239/332
2012/0260931 A1 * 10/2012 Martin ..... A46B 13/02 132/200
2012/0328353 A1 12/2012 Svendsen
2013/0118515 A1 * 5/2013 Wurtz ..... A46B 11/08 132/200
2013/0123825 A1 * 5/2013 Demjanenko ..... A61M 5/3287 606/185
2013/0158547 A1 * 6/2013 David ..... A61B 18/14 606/41
2013/0223915 A1 8/2013 Simonian
2014/0000047 A1 1/2014 Boyd
2014/0014543 A1 * 1/2014 Hohlbein ..... A46B 11/0003 206/368
2014/0064821 A1 * 3/2014 Price ..... A46B 11/0041 401/183
2014/0219705 A1 * 8/2014 Posnick ..... A45D 33/02 401/270
2014/0360527 A1 * 12/2014 Thompson ..... A46B 11/001 132/309
2015/0308421 A1 * 10/2015 Vogt ..... A61M 3/0258 604/146
2016/0015150 A1 * 1/2016 Casasanta, III ..... A45D 40/262 401/4

FOREIGN PATENT DOCUMENTS

| | | | |
|---|---|---|---|
| FR | 2 992 856 | A1 | 1/2014 |
| JP | 2013-106741 | A | 6/2013 |
| KR | 10-1311142 | B1 | 9/2013 |
| WO | 2006/090998 | A1 | 8/2006 |
| WO | 2011/009282 | A1 | 1/2011 |
| WO | 2013/096520 | A1 | 6/2013 |
| WO | 2014/009282 | A2 | 1/2014 |

OTHER PUBLICATIONS

Invitation to Pay Additional Fees and Partial International Search mailed Jul. 31, 2015, issued in corresponding International Application No. PCT/US2015/028562, filed Apr. 30, 2015, 5 pages.

* cited by examiner

COSMETIC FORMULATION DISPENSING HEAD FOR A PERSONAL CARE APPLIANCE

BACKGROUND

Many people use cosmetic formulations on a regular basis. An individual may use a number of cosmetic formulations, such as makeup, personal soaps, skin care products, hair care products or other cosmetic products, on a daily basis. These cosmetic products typically are sold and stored in containers, such as jars or bottles.

Traditional containers of cosmetic formulations are difficult to keep clean. As cosmetic formulations are used from a container, residue from the cosmetic formulations can be left on the container. Residue from some cosmetic formulations, such as makeup, can inadvertently transfer to skin or clothing and stain or otherwise discolor the skin or clothing. Residue from some cosmetic formulations can also interfere with operation of the container. For example, residue from a cosmetic formulation can be left on threads of a container with a screw-on cap. Such residue can make it difficult to properly remove or tighten a cap on the container.

Containers of cosmetic formulations may not properly protect the cosmetic formulation. Cosmetic formulations can be adversely affected by exposure to air. Some cosmetic formulations, such as makeup, can be discolored from exposure to air over time. Some cosmetic formulations can dry up or permanently change viscosity with prolonged exposure to air. Individuals may use cosmetic formulations at times when they are not as diligent about cleaning up, such as getting ready in the morning while being concerned about not leaving the home late. In such cases, individuals may leave containers of cosmetic formulations open, exposing the cosmetic formulations to air, for prolonged periods of time.

The way that cosmetic formulations are stored and dispensed can be improved to address container cleanliness, protection of cosmetic formulations, and other issues.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a cosmetic formulation applicator is provided for applying cosmetic formulation to a user's skin. The cosmetic formulation applicator includes a reservoir that contains a cosmetic formulation. The cosmetic formulation applicator also includes a brush head base, a plurality of bristles, and one or more dispenser nozzles. The brush head base is attached to the reservoir on a first side of the brush head base and the plurality of bristles extend from a second side of the brush head base. The one or more dispenser nozzles are configured to permit passage of the cosmetic formulation from the reservoir through the brush head base to the plurality of bristles. The cosmetic formulation applicator also includes a plunger that is configured to force cosmetic formulation from the reservoir to the plurality of bristles via the plurality of dispenser nozzles. The plunger is capable of being selectively driven to control flow of the cosmetic formulation through the plurality of dispenser nozzles.

In some embodiments of the cosmetic formulation applicator, the plurality of bristles terminate in the cosmetic application tips. The one or more dispenser nozzles are configured to dispense cosmetic formulation near the cosmetic application tips of the plurality of bristles. The cosmetic formulation applicator can include an appliance that is coupled to the cosmetic formulation applicator and that is configured to selectively vibrate. The vibration of the appliance can cause the cosmetic application tips of the plurality of bristles to produce a finish of the cosmetic formulation on a surface. In one example, the appliance can include an electric motor that is configured to drive the plunger during vibration of the appliance.

In other embodiments of the cosmetic formulation applicator, one or more dispenser nozzles comprise a flexible material. The flexible material can be an elastomeric polymer material. In other embodiments of the cosmetic formulation applicator, the plunger can include a gasket that seals the side of the plunger against an interior wall of the reservoir. The cosmetic formulation applicator can also include a jack screw that is configured to drive the plunger when turned. The jack screw can be fed through a threaded bushing in the plunger. The jack screw can also be configured to be selectively turned by a drive gear assembly coupled to an electric motor. The cosmetic formulation can include at least one of makeup, personal soap, skin care product, or hair care product.

In accordance with aspects of the present disclosure, a system is provided for applying and finishing cosmetic formulations. The system can include an appliance and a cosmetic formulation. The appliance can include an electric motor coupled to a drive gear assembly. The cosmetic formulation applicator head can be configured to be selectively attached to the appliance. The cosmetic formulation applicator head can include a reservoir that includes a cosmetic formulation, a brush head base, a plurality of bristles, and one or more dispenser nozzles. The brush head base can be attached to the reservoir on a first side of the brush head base. The plurality of bristles can extend from a second side of the brush head base. The one or more dispenser nozzles can be configured to permit passage of the cosmetic formulation from the reservoir through the brush head base to the plurality of bristles. The cosmetic formulation applicator head can also include a jack screw gear configured to engage the drive gear assembly when the cosmetic formulation applicator head is attached to the appliance. The jack screw gear can drive the plunger to control flow of the cosmetic formulation to the plurality of bristles when turned by the drive gear assembly.

In some embodiments of the system, the appliance can also include a rechargeable battery that is capable of providing power to the electric motor. The appliance can be selectively attachable to other heads. The appliance can also include one or more control buttons that permit a user to control operation of the electric motor. The jack screw gear can be configured to turn a jack screw that is fed through a threaded bushing in the plunger. The plurality of bristles can extend beyond ends of the plurality of dispenser nozzles. The one or more dispenser nozzles can be configured to dispense the cosmetic formulation near a tip end of the plurality of bristles such that the cosmetic formulation is applied to a surface in contact with the tip end of the plurality of bristles.

In accordance with aspects of the present disclosure, a cosmetic formulation applicator is provided for applying and finishing a cosmetic formulation. The cosmetic formulation applicator includes a reservoir, a brush head base, a plurality of bristles, and one or more dispenser nozzles. The reservoir includes a cosmetic formulation. The brush head base is attached to the reservoir on a first side of the brush head base. The one or more dispenser nozzles are configured to permit passage of the cosmetic formulation from the reservoir through the brush head base to the plurality of bristles. The cosmetic formulation has a viscosity that inhibits flow of the cosmetic formulation through the one or more dispenser nozzles when the cosmetic formulation applicator is at rest. Vibration of the cosmetic formulation applicator can cause a shear rate of the cosmetic formulation to decrease and the viscosity of the cosmetic formulation such that the cosmetic formulation is capable of flowing through the one or more dispenser nozzles. In one example, the cosmetic formulation applicator can be attachable to an appliance that is configured to cause the vibration of the cosmetic formulation applicator.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples of systems, apparatuses, and/or methods for applying cosmetics formulations. The examples described herein provide formulation applicator heads suitable for use with a personal care appliance. In some examples described herein, the personal care appliance can drive a plunger in a formulation applicator head to dispense formulation from a reservoir in the formulation applicator head. In other examples, the personal care appliance can provide improved finishing of a cosmetic formulation applied to a user's skin by vibrating to cause bristles on the formulation applicator head to vibrate over the cosmetics formulation on the user's skin.

In the examples set forth herein, the vibrations of the personal care appliance may be rotational, translational, or a combination thereof. In use, the combination of the formulation applicator head and the personal care appliance can both apply formulation to and finish formulation on a user's skin without the need to pre-apply the formulation to the user's skin. Moreover, the formulation applicator head can contain the formulation until the formulation is applied to the user's skin to reduce waste of the formulation and alleviate effects of the formulation due to exposure to air.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1:
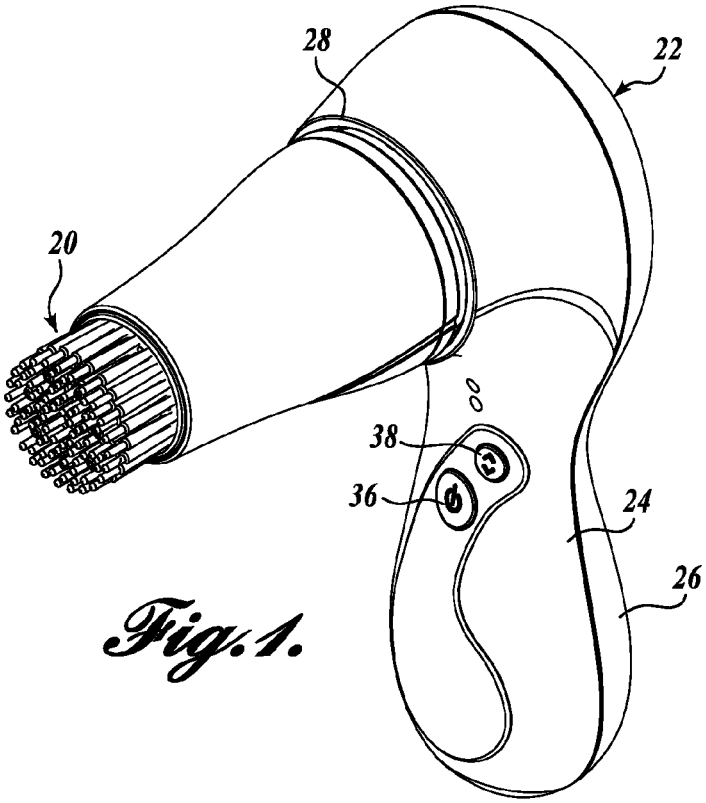
FIG. 1 is a perspective view of one example of a formulation applicator head and an appliance in accordance with aspects of the present disclosure.
Figure 2:
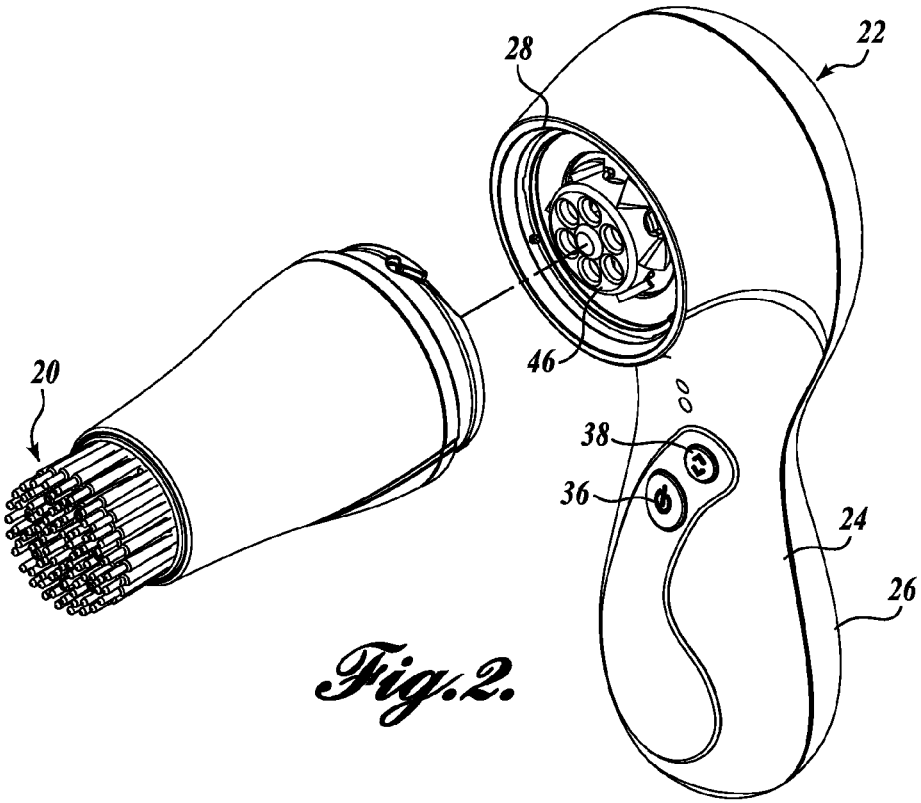
FIG. 2 is an exploded view of the formulation applicator head and the appliance of FIG. 1.
Figure 8:
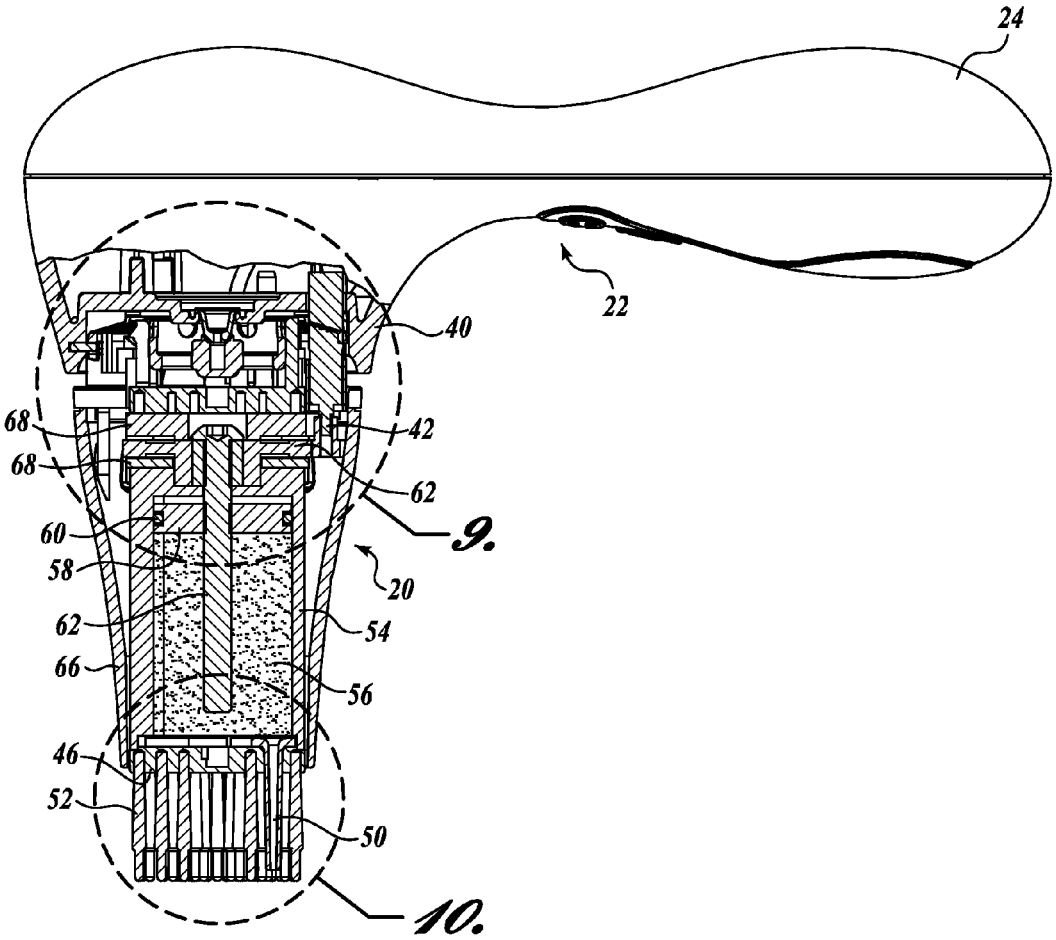
FIG. 8 is a partial cross-sectional view of the example of the formulation applicator head and the appliance of FIG. 1.
Figure 9:
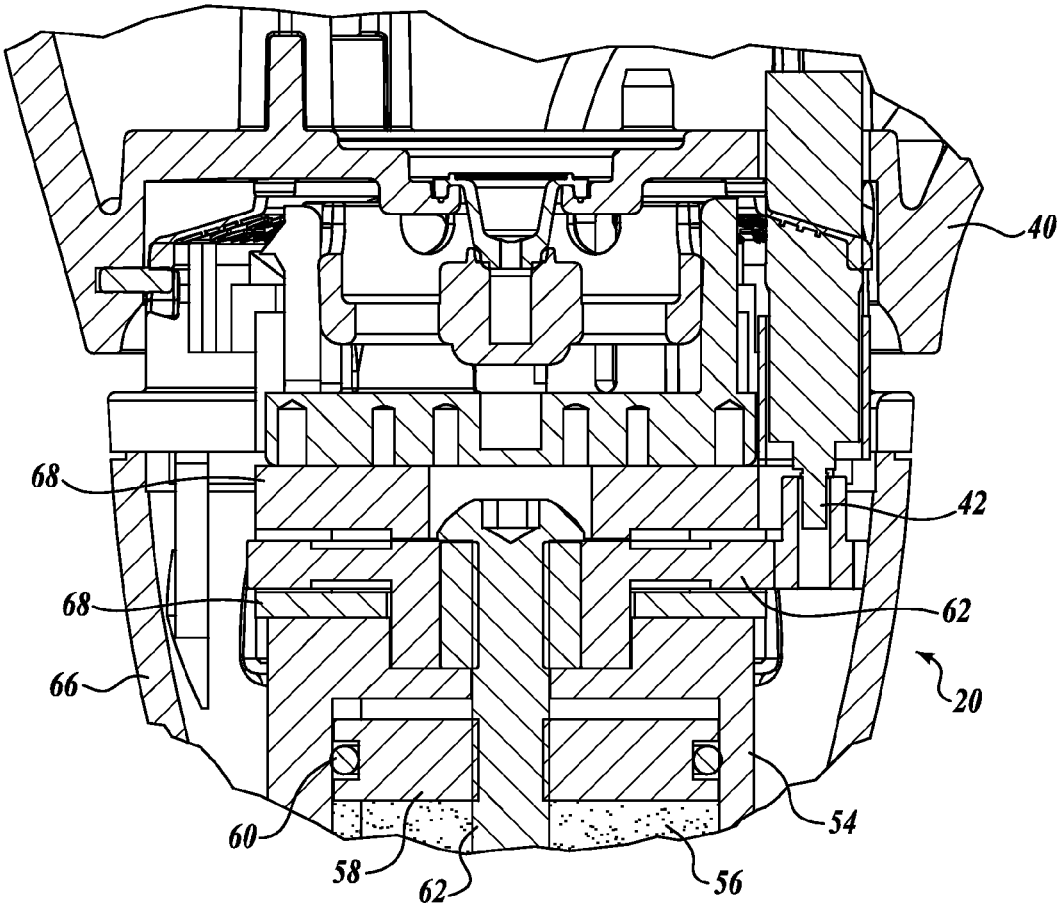
FIG. 9 is a partial cross-sectional view of the formulation applicator head and the appliance of FIG. 1.
Figure 10:
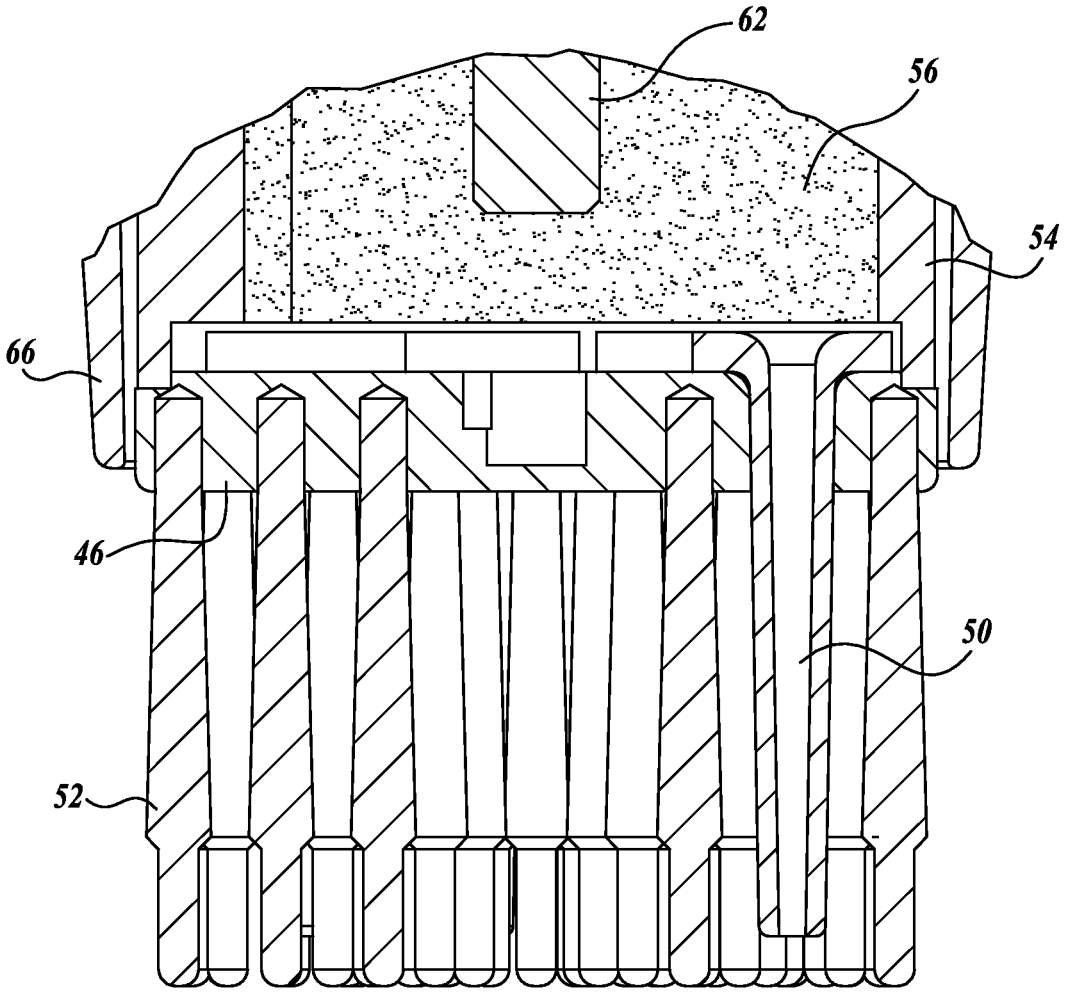
FIG. 10 is a partial cross-sectional view of the formulation applicator head of FIG. 1.

Turning now to FIGS. 1 and 2, there is shown one example of a cosmetic formulation applicator head, generally designated 20, formed in accordance with aspects of the present disclosure. The cosmetic formulation applicator head 20 is suitable for use with a personal care appliance, such as the appliance 22. Cross-sectional views of portions of the cosmetic formulation applicator head 20 and the appliance 22 are depicted in some of FIGS. 8, 9, and 10. The cosmetic formulation applicator head 20, in some embodiments, includes a plurality of dispenser nozzles 50 that can dispense cosmetic formulation 56 to an area near tips of a group of bristles 52. The container 54 can be held in place within the cosmetic formulation applicator head 20 with one or more brackets 68. The bristles 52 can be moved and/or vibrated over the user's skin in order to provide a finish to the personal care formulation that has been applied to the user's skin. As will be described in more detail below, some embodiments utilize sonic motion to vibrate the cosmetic formulation applicator head 20, which can provide improved finishing of the formulation that has been applied to the user's skin.

Prior to describing the cosmetic formulation applicator head 20 in more detail, one example of a personal care appliance 22 that may be employed to impart an oscillating motion to the cosmetic formulation applicator head 20 will be described in some detail. While the personal care appliance 22 is one type of appliance that can be practiced with embodiments of the present disclosure, it will be appreciated that the cosmetic formulation applicator head 20 is suitable for use with a wide range of oscillatory or vibratory motion generating devices.

Figure 5:
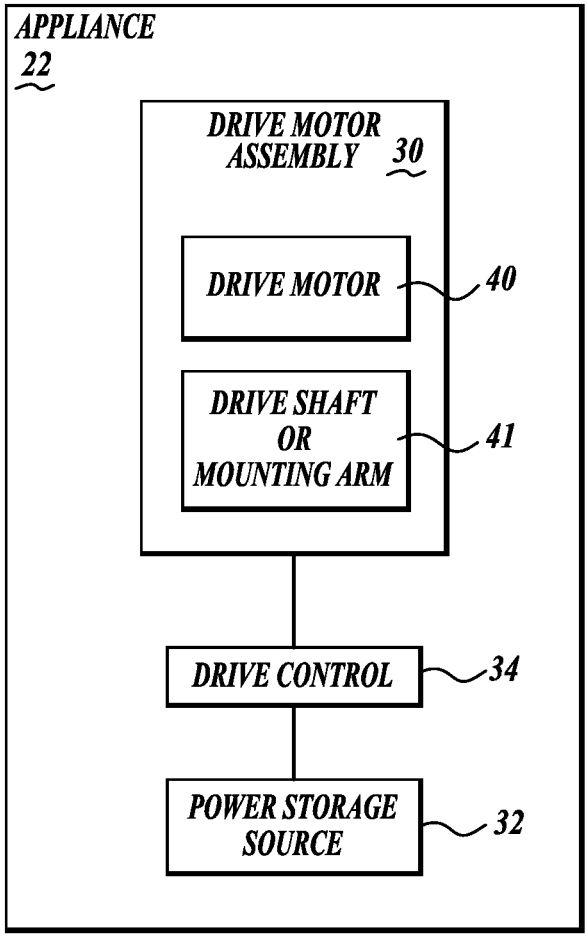
FIG. 5 is a functional block diagram of several components of the personal care appliance of FIG. 1.

Also with respect to FIGS. 1 and 2, there is shown one example of the personal care appliance 22. The appliance 22 includes a body 24 having a handle portion 26 and a head attachment portion 28. The head attachment portion 28 is configured to selectively attach a head, such as cosmetic formulation applicator head 20, to the appliance 22. The appliance body 24 houses the operating structure of the appliance. As shown in block diagrammatic form in FIG. 5, the operating structure in one embodiment includes a drive motor assembly 30, a power storage source 32, such as a rechargeable battery, and a drive control 34 that includes an on/off button 36 (e.g., in FIGS. 1 and 2) configured and arranged to selectively deliver power from the power storage source 32 to the drive motor assembly 30. In some embodiments, the drive control 34 may also include a power adjust or mode control buttons 38 coupled to control circuitry, such as a programmed microcontroller or processor, which is configured to control the delivery of power to the drive motor assembly 30. The drive motor assembly 30 in some embodiments includes an electric drive motor 40 that drives an attached head, such as cosmetic formulation applicator head 20, via a drive gear assembly.

When the cosmetic formulation applicator head 20 is mounted to the head attachment portion 28, the drive motor assembly 30 is configured to impart motion to the cosmetic formulation applicator head 20. The appliance 22 may be configured to vibrate the cosmetic formulation applicator head 20 at sonic frequencies, typically in the range of 80-162 Hz. In some embodiments, the appliance 22 is vibrated at frequencies from about 94 Hz to 106 Hz and a duty cycle of about 38-44%.

One example of a drive motor assembly 30 that may be employed by the appliance 22 to oscillate the cosmetic formulation applicator head 20 is shown and described in U.S. Pat. No. 7,786,646. However, it should be understood that this is merely an example of the structure and operation of one such appliance and that the structure, operation frequency and oscillation amplitude of such an appliance could be varied, depending in part on its intended application and/or characteristics of the applicator head, such as its inertial properties, etc. In some embodiments of the present disclosure, the frequency ranges are selected so as to drive the attached head at near resonance. Thus, selected frequency ranges are dependent, in part, on the inertial properties of the attached head. It will be appreciated that driving the attached head at near resonance provides many benefits, including the ability to drive the attached head at suitable amplitudes in loaded conditions (e.g., when contacting the skin). For a more detailed discussion on the design parameters of the appliance, please see U.S. Pat. No. 7,786,646.

Figure 3:
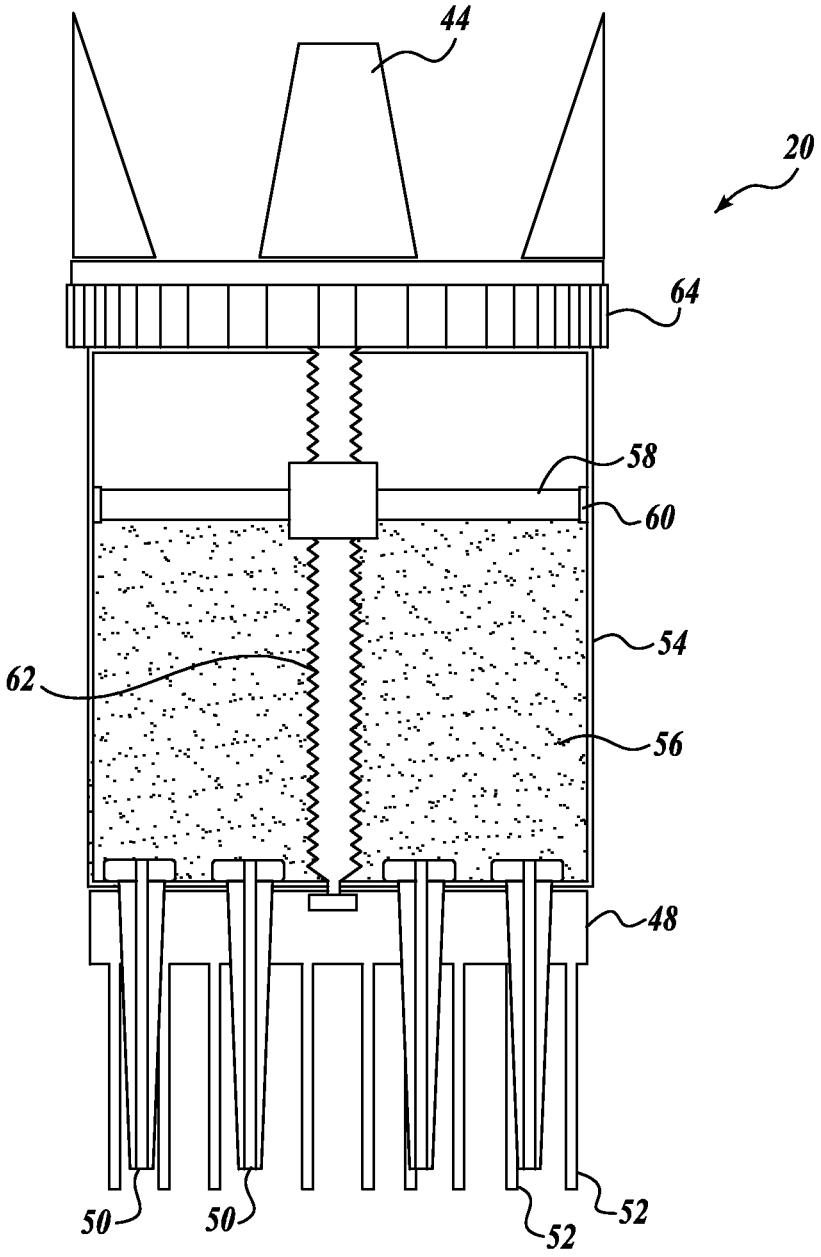
FIG. 3 is a diagram of components of one example of a formulation applicator head in accordance with aspects of the present disclosure.
Figure 4:
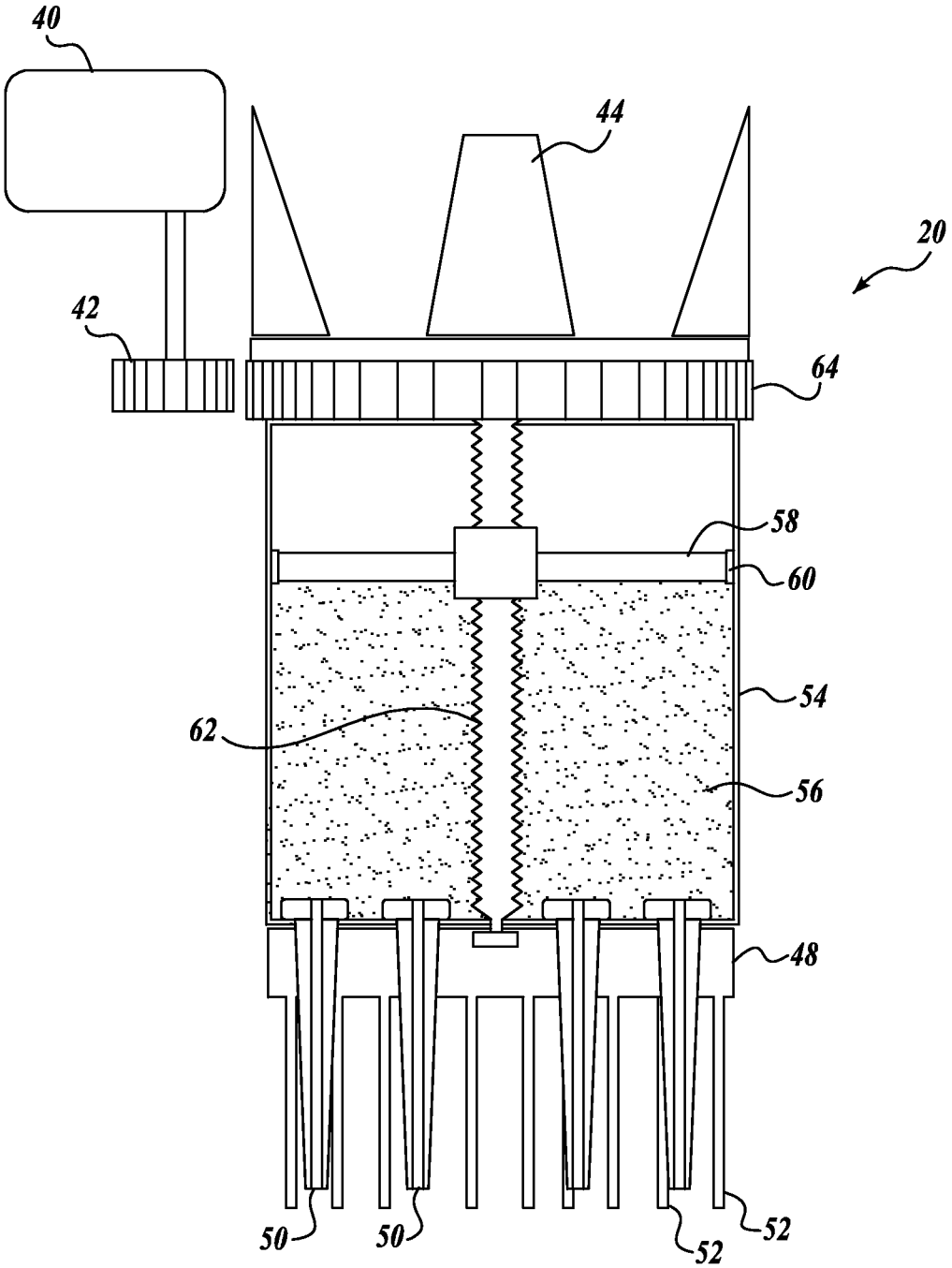
FIG. 4 is a diagram of components of one example of the formulation applicator head of FIG. 3 and one example of components of a personal appliance.

Turning now to FIGS. 3 and 4, one example of the cosmetic formulation applicator head 20 will be described in more detail. The cosmetic formulation applicator head 20 includes an interface end 44 that is configured to interface with a mating interface 46 (illustrated in FIG. 2) on appliance 22. When the cosmetic formulation applicator head 20 is attached to the appliance 22, vibrations of the appliance 22 can be transferred to the cosmetic formulation applicator head 20 to cause the cosmetic formulation applicator head 20 to vibrate in a similar manner.

The cosmetic formulation applicator head 20 also includes a brush head base 48.

The bristles 52 extend from the brush head base 48. Each of the bristles 52 terminates in a tip. The dispenser nozzles 50 pass through the brush head base 48 and terminate near the tips of the bristles 52. In some embodiments, the bristles 52 extend further away from the brush head base 48 than the dispenser nozzles 50 extend from the brush head base 48. The dispenser nozzles 50 can be made of a flexible material, such as an elastomeric polymer. The bristles 52 can be long and soft such that the bristles 52 vibrate when the appliance 22 vibrates. The bristles 52 may be made of polybutylene terephthalate (PBT), polyethylene terephthalate (PET), nylon, polyester, a thermoplastic elastomer (TPE), combinations thereof, etc. When the bristles 52 are in contact with cosmetic formulation on a user's skin, the vibration of the bristles 52 can produce a particular finish of the cosmetic formulation on the user's skin.

In some embodiments, the bristles 52 are generally circular in cross-section, although the cross-sections of the bristles 52 may vary, including square cross sections, X-shaped cross sections, etc. Additionally, the bristles 52 in some embodiments are formed with or without rounded ends. Further, the bristles 52 may be treated with anti-microbial agents in some embodiments or coated with an anti-microbial material, such as silver zeolites, zinc, copper, gold, etc. In other embodiments, the use of silver zeolite may be compounded into the resin that is used to construct the bristles 52 to reduce the bacterial and fungal effects on the bristles.

In some embodiments, the bristles 52 can be spaced out from each other. The dispenser nozzles 50 can also be spaced out from each other and from the bristles 52. In some embodiments, the dispenser nozzles 50 and the bristles 52 can be arranged in random fashion while in other embodiments the dispenser nozzles 50 and the bristles 52 can be arranged in one or more patterns. In these embodiments, the one or more patterns can be constant throughout the majority of the brush head base 46 or can vary throughout the majority of the brush head base 46 or parts thereof. The dispenser nozzles 50 can be arranged in a pattern, such as six dispenser nozzles arranged at the corners of a hexagon. Any number of other patterns can be used, such as four nozzles in a square pattern, five nozzles in a pentagon pattern, eight nozzles in an octagon pattern, a number of nozzles in a matrix pattern, or a number of nozzles in a spoke pattern.

Between the interface end 44 and the brush head base 48 is a reservoir 54. The reservoir 54 can contain cosmetic formulation 56. The cosmetic formulation 56 can be any cosmetic formulation, such as makeup, personal soap, skin care product, hair care product, or any other cosmetics product. Makeup can include foundation, blush, highlighter, bronzer, or any other type of makeup. Personal soap can include facial cleanser, body wash, or any other type of personal soap. Skin care products can include lotions, skin exfoliants, masking formulations, or any other type of skin care product. Hair care products can include shampoos, conditioners, shaving cream, or any other type of hair care products.

The reservoir 54 can be in the form of a canister or any other shape. The reservoir 54 can have a plunger 58. A gasket 60 can be located around the edge of the plunger 58 to seal the edge of the plunger 58 to the sides of the reservoir 54. As the plunger 58 moves toward the brush head base 48, cosmetic formulation 56 is forced through the dispenser nozzles 50 to be applied near the tips of the bristles 52. In this manner, cosmetic formulation 56 can be applied to a user's skin that is in contact with the tips of the bristles 52.

A jack screw 62 can be fed through a threaded bushing in the plunger 58. In one embodiment, the threaded bushing can be located at or near the center of the plunger 58. The jack screw 62 can span the length of the reservoir 54, from the brush head base 48 to a jack screw gear 64. The jack screw 62 can be turned by turning the jack screw gear 64. In one embodiment, the jack screw 62 is affixed to the jack screw gear 64 to form a jack screw assembly. When the jack screw gear 64 is turned, the jack screw 62 is also turned and causes the plunger 58 to move in a direction parallel to the axis of the jack screw 62. While the jack screw 62 is one example of a mechanism that can move the plunger 58, other mechanisms could be used. For example, an actuator could move the plunger 58 to dispense the cosmetic formulation 56 from the reservoir 54.

As is shown in FIG. 3, the jack screw 62 and jack screw gear 64 can be contained in the cosmetic formulation applicator head 20. The appliance 22 can have an electric drive motor 40 that drives a drive gear assembly 42. When the cosmetic formulation applicator head 20 is attached to the appliance 22, the drive gear assembly 42 can engage the jack screw gear 64, as is shown in FIG. 4. In this manner, drive gear motor 40 can cause the plunger 58 to move by turning the drive gear assembly 42 which turns the jack screw gear 64 and the jack screw 62 to move the plunger 58. Movement of the plunger 58 toward the brush head base 48 causes cosmetic formulation 56 to be dispensed out of the reservoir 54.

The rate at which the cosmetic formulation 56 is dispensed from the reservoir 54 can be based on one or more of the following factors: the speed of the electric drive motor 40, the gear ratio between the electric drive motor 40 and the drive gear assembly 42, the gear ratio between the drive gear assembly 42, and the jack screw gear 64. In one embodiment, the speed of the electric drive motor 40 is controlled to control the amount of rate at which the cosmetic formulation 56 is dispensed from the reservoir 54. For example, the speed of the electric drive motor 40 can be adjusted based on user inputs into the appliance 22, such as presses of power adjust or mode control buttons 38.

The cosmetic formulation 56 can remain inside of the reservoir 54 until it is dispensed via dispenser nozzles 50. In this way, the cosmetic formulation 56 may not be exposed to air until it is dispensed from the reservoir 54. Preventing the cosmetic formulation 56 from being exposed to air until it is dispensed and applied to a user's skin may improve consistency in the color and texture of the cosmetic formulation 56 applied to the user's skin. Additionally, containing the cosmetic formulation 56 in the reservoir 54 until it is applied to the user's skin may reduce waste of the cosmetic formulation 56 that might occur from an open container, such as inadvertent spills of the cosmetic formulation 56.

Figure 6:
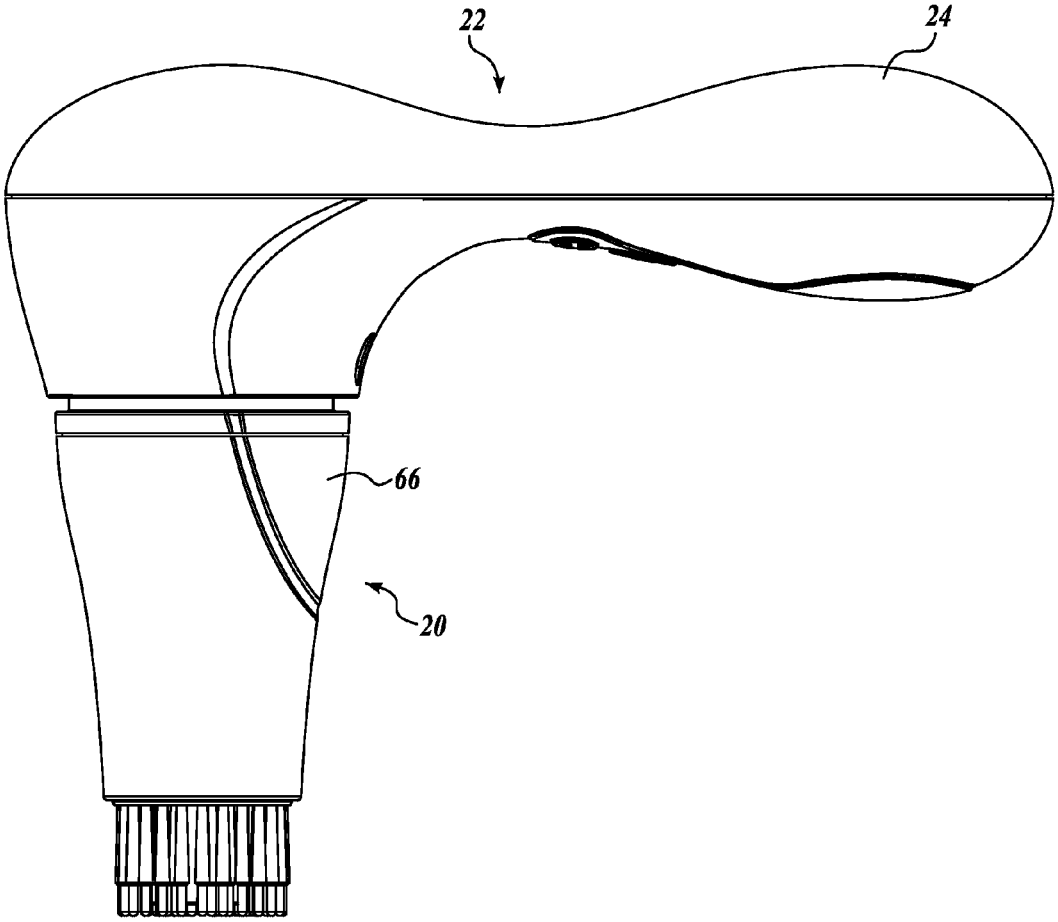
FIG. 6 is a side view of one example of a formulation applicator head attached to a personal care appliance in accordance with aspects of the present disclosure.
Figure 7:
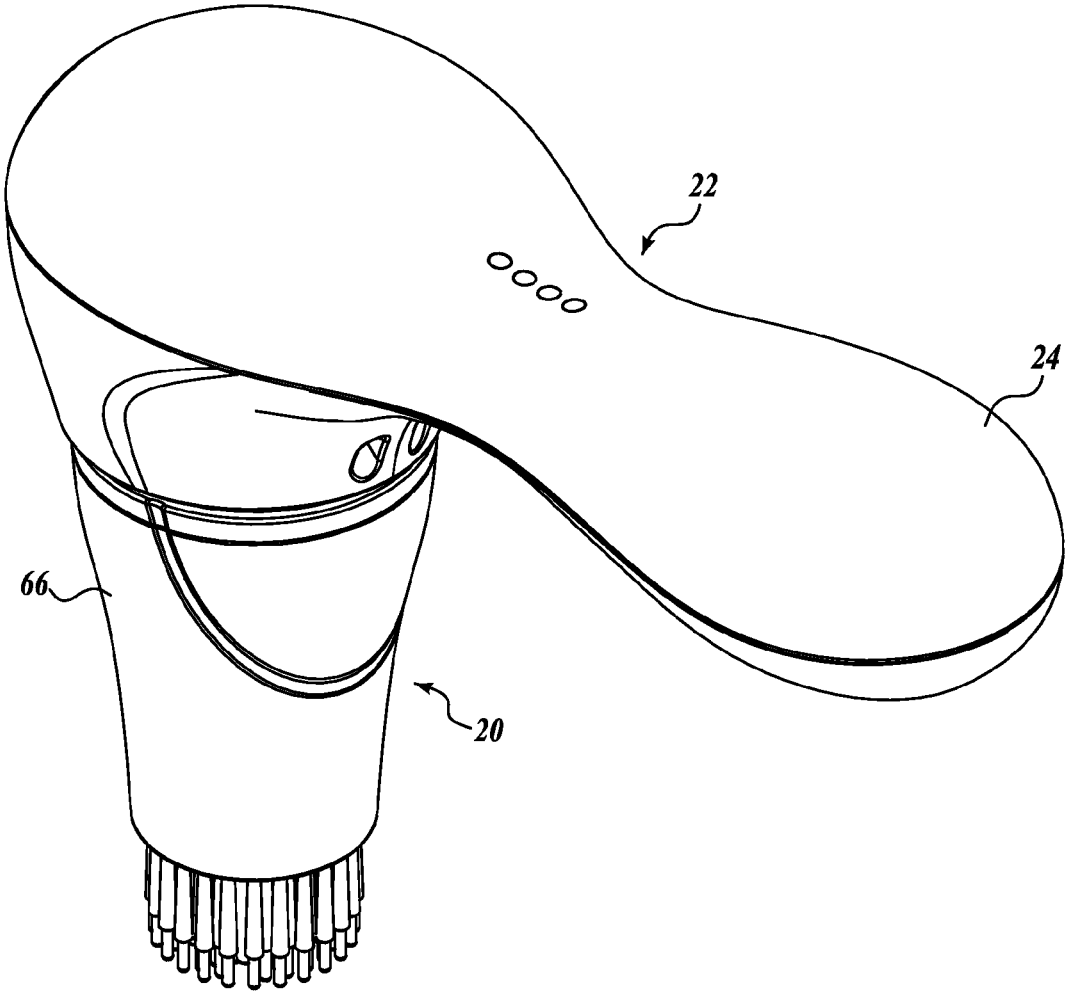
FIG. 7 is a perspective view of the formulation applicator head attached to the personal care appliance of FIG. 6.

FIGS. 6 and 7 depict an embodiment of a cosmetic formulation applicator head 20 attached to an appliance 22. The appliance 22 has an appliance body 24 and the cosmetic formulation applicator head 20 has a head body 66. The head body can encompass and protect parts inside of the cosmetic formulation applicator head 20, such as a reservoir 54, a jack screw assembly, and the like. The appliance body 24 of the appliance 22 and the head body 66 of the cosmetic formulation applicator head 20 can be constructed out of plastic, such as nylon, polypropylene, polyurethane, polyethylene, etc., although other materials may be utilized, including lightweight metals, such as aluminum, titanium, etc. In one embodiment, when the cosmetic formulation applicator head 20 is attached to the appliance 22, the head body 66 can be flush with the appliance body 24. In other embodiments, when the cosmetic formulation applicator head 20 is attached to the appliance 22, the head body 66 can be spaced apart from the appliance body 24 with a gap in between.

In some embodiments, the cosmetic formulation applicator head 20 and the appliance 22 can include an attachment system configured to provide selective attachment of the cosmetic formulation applicator head 20 to the appliance 22. In some embodiments, the attachment system can provide a quick and easy technique for attaching and detaching the cosmetic formulation applicator head 20 to the appliance 22. The attachment system can also allow for any number of other personal care heads to be attached to the appliance 22. For example, when the supply of cosmetic formulation 56 in the reservoir 54 is exhausted, the cosmetic formulation applicator head 20 can be detached and a replacement cosmetic formulation applicator head can be attached. In another example, when the user wants to use a cosmetic formulation that is different from the cosmetic formulation 56 in the cosmetic formulation applicator head 20, the cosmetic formulation applicator head 20 can be detached from the appliance 22 and another cosmetic formulation applicator head can be attached to the appliance 22. In the latter example, when the user wants to use the cosmetic formulation applicator head 20 again, the user can detach the other cosmetic formulation applicator head and reattach the cosmetic formulation applicator head 20.

One attachment system that may be practiced with embodiments of the present disclosure is set forth in U.S. Pat. No. 7,386,906. It will be appreciated that other attachment systems can be employed to provide either tooled or tool-less techniques for selectively attaching the cosmetic formulation applicator head 20 to a personal care appliance, such as appliance 22, in a manner that (1) transmits vibrations from the appliance 22 to the cosmetic formulation applicator head 20, and/or (2) engages the drive gear assembly 42 to the jack screw gear 64. In some embodiments, an optional retainer on one of the cosmetic formulation applicator head 20 or the appliance 22 may be used to attach the cosmetic formulation applicator head 20 to the appliance 22.

The above-described examples of the cosmetic formulation applicator head 20 can be used to apply cosmetic formulation to a user's skin and to apply a finish to the cosmetic formulation on the user's skin. In that regard, the cosmetic formulation applicator head 20 is first attached to the personal care appliance 22. The cosmetic formulation 56 can be dispensed from the reservoir 54 via the dispenser nozzles 50 to the tips of the bristles 52. Next, the dispensed cosmetic formulation can be applied by brushing the tips of the bristles 52 against the user's skin. Next, if desired, a finish can be applied to the cosmetic formulation applied to the user's skin by vibrations of the tips of the bristles 52 as the bristles 52 are brushed against the user's skin. The vibrations of the tips of the bristles 52 can be caused by vibrations of the appliance 22.

Figure 11:
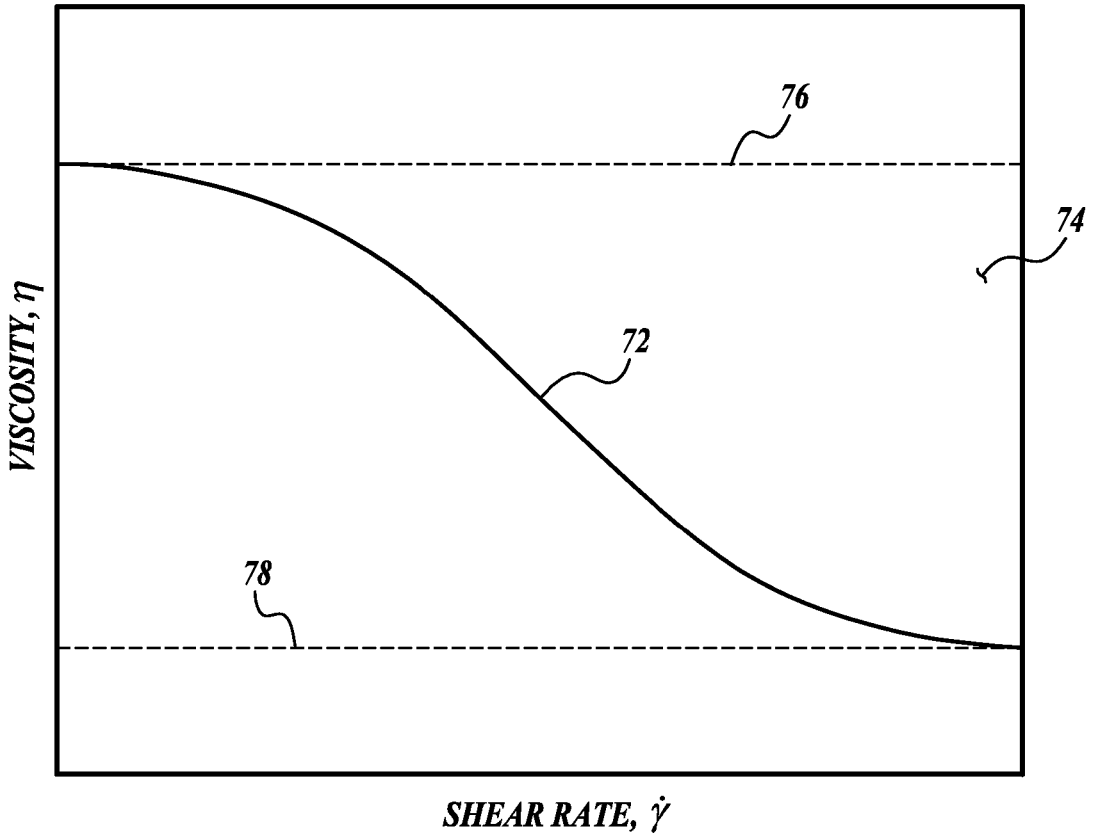
FIG. 11 is a depiction of a chart with an example of a cosmetic formulation viscosity curve that shows the relationship of viscosity, $\eta$, as a function of shear rate, $\dot{\gamma}$.

In another embodiment, cosmetic formulation 56 can be dispensed from the reservoir 54 by changing the shear rate of the cosmetic formulation 56. FIG. 11 depicts a chart with an example of a cosmetic formulation viscosity curve 72 that shows the relationship of viscosity, $\eta$, as a function of shear rate, $\dot{\gamma}$, of particular cosmetic formulations, such as thick foundations. The cosmetic formulation viscosity curve 72 is located in a shear-thinning region 74. When the shear rate is low, the cosmetic formulation viscosity curve 72 is near a zero-shear Newtonian plateau, $\eta_0$, 76. As the shear rate is increased, the cosmetic formulation viscosity curve 72 drops until it approaches an infinite-shear Newtonian plateau, $\eta_{n\infty}$, 78. Thus, as the shear rate of a cosmetics formulation, the viscosity of the cosmetics formulation can decrease to allow the cosmetics formulation to flow more freely.

The shear-thinning phenomenon described above can be applied to the particular example of the cosmetic formulation applicator head 20 and the appliance 22 in FIGS. 1 and 3. The appliance 22 can have a motor, such as an oscillatory motor, that can be activated. When the motor is activated, the movement of the motor can vibrate the cosmetic formulation applicator head 20, causing the shear rate of the cosmetic formulation 56 in container 54 to increase. As the shear rate of the cosmetic formulation 56 increases, the viscosity of the cosmetic formulation 56 can decrease. The combination of reduced viscosity of the cosmetic formulation 56 and the force of gravity can cause the cosmetic formulation 56 to pass through the dispenser nozzles 50 without the plunger 58 being driven toward the brush head base 48.

In one embodiment, the cosmetic formulation 56 can be a foundation that is water in silicon pigmented emulsion with low water level and high silicone elastomer content. For example, the foundation can include 7% distilled water, 3.775% isododecane, and 3% dimethicone.

The methods described above can be carried out to apply a cosmetic formulation to a user's skin and to finish the cosmetic formulation on the user's skin. However, any type of formulation, such as other personal care formulations, can be used as part of the method disclosed above.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A cosmetic formulation applicator, attachable to an appliance that is configured to selectively vibrate the cosmetic formulation applicator by a single drive motor assembly, wherein the appliance further includes a drive control having a programmed microcontroller that is configured to selectively supply power to the single drive motor assembly, the cosmetic formulation applicator comprising:

a reservoir comprising a cosmetic formulation;

a brush head base attached to the reservoir on a first side of the brush head base;

a plurality of bristles extending from a second side of the brush head base;

one or more dispenser nozzles configured to permit passage of the cosmetic formulation from the reservoir through the brush head base to the plurality of bristles; and a plunger configured to force cosmetic formulation from the reservoir to the plurality of bristles via the plurality of dispenser nozzles;

wherein the plunger is capable of being selectively driven by the single drive motor assembly of the appliance when the single drive motor assembly vibrates the cosmetic formulation applicator to control flow of the cosmetic formulation through the plurality of dispenser nozzles, wherein the single drive motor assembly vibrates the cosmetic formulation applicator when the programmed microcontroller supplies power to the single drive motor assembly.

2. The cosmetic formulation applicator of claim 1, wherein the plurality of bristles terminate in cosmetic application tips.

3. The cosmetic formulation applicator of claim 2, wherein the one or more dispenser nozzles are configured to dispense cosmetic formulation near the cosmetic application tips of the plurality of bristles.

4. The cosmetic formulation applicator of claim 1, wherein the vibration of the appliance is configured to cause the cosmetic application tips of the plurality of bristles to produce a finish of the cosmetic formulation on a surface.

5. The cosmetic formulation applicator of claim 1, wherein the single drive motor assembly comprises an electric motor configured to drive the plunger during vibration of the appliance.

6. The cosmetic formulation applicator of claim 1, wherein the one or more dispenser nozzles comprise a flexible material.

7. The cosmetic formulation applicator of claim 6, wherein the flexible material is an elastomeric polymer material.

8. The cosmetic formulation applicator of claim 1, wherein the plunger comprises a gasket that seals the side of the plunger against an interior wall of the reservoir.

9. The cosmetic formulation applicator of claim 1, further comprising a jack screw configured to drive the plunger when turned.

10. The cosmetic formulation applicator of claim 9, wherein the jack screw is fed through a threaded bushing in the plunger.

11. The cosmetic formulation applicator of claim 9, wherein the jack screw is configured to be selectively turned by a drive gear assembly coupled to an electric motor.

12. The cosmetic formulation applicator of claim 1, wherein the cosmetic formulation comprises at least one of makeup, personal soap, skin care product, or hair care product.

13. A system for applying and finishing cosmetic formulations, the system comprising:

an appliance comprising a single electric motor coupled to a drive gear assembly and a drive control having a programmed microcontroller that is configured to selectively supply power to the single electric motor; and a cosmetic formulation applicator head configured to be selectively attached to the appliance, wherein the single electric motor of the appliance is configured to selectively vibrate the cosmetic formulation applicator head when the programmed microcontroller supplies power to the single electric motor, the cosmetic formulation applicator head comprising:

a reservoir comprising cosmetic formulation, a brush head base attached to the reservoir on a first side of the brush head base, a plurality of bristles extending from a second side of the brush head base, one or more dispenser nozzles configured to permit passage of the cosmetic formulation from the reservoir through the brush head base to the plurality of bristles, a plunger arranged to force cosmetic formulation from the reservoir to the plurality of bristles via the plurality of dispenser nozzles, and a jack screw gear configured to engage the drive gear assembly when the cosmetic formulation applicator head is attached to the appliance, the jack screw gear capable of driving the plunger to control flow of the cosmetic formulation to the plurality of bristles when turned by the drive gear assembly, wherein the drive gear assembly turns the jack screw gear while the single electric motor vibrates the cosmetic formulation applicator head.

14. The system of claim 13, wherein the appliance further comprises a rechargeable battery, the rechargeable battery capable of providing power to the single electric motor.

15. The system of claim 13, wherein the appliance is selectively attachable to other heads.

16. The system of claim 13, wherein the appliance further comprises one or more control buttons configured to permit a user to control operation of the single electric motor.

17. The system of claim 16, wherein the jack screw gear is configured to turn a jack screw that is fed through a threaded bushing in the plunger.

18. The system of claim 13, wherein the plurality of bristles extend beyond ends of the plurality of dispenser nozzles.

19. The system of claim 13, wherein the one or more dispenser nozzles are configured to dispense the cosmetic formulation near a tip end of the plurality of bristles such that the cosmetic formulation is applied to a surface in contact with the tip end of the plurality of bristles.

20. A cosmetic formulation applicator attachable to an appliance that is configured to selectively vibrate the cosmetic formulation applicator by a single drive motor assembly, wherein the appliance further includes a drive control having a programmed microcontroller that is configured to selectively supply power to the single drive motor assembly, the cosmetic formulation applicator comprising:

a reservoir comprising a cosmetic formulation;

a brush head base attached to the reservoir on a first side of the brush head base;

a plurality of bristles extending from a second side of the brush head base; and one or more dispenser nozzles configured to permit passage of the cosmetic formulation from the reservoir through the brush head base to the plurality of bristles;

wherein the cosmetic formulation has a viscosity that inhibits flow of the cosmetic formulation through the one or more dispenser nozzles when the cosmetic formulation applicator is at rest; and wherein vibration of the reservoir within the cosmetic formulation applicator by the single drive motor assembly causes a shear rate of the cosmetic formulation to decrease the viscosity of the cosmetic formulation such that the cosmetic formulation is capable of flowing through the one or more dispenser nozzles, wherein the single drive motor assembly vibrates the cosmetic formulation applicator when the programmed microcontroller supplies power to the single drive motor assembly.

* * * * *